US006077399A

United States Patent [19]

Calderon et al.

[11] Patent Number: 6,077,399

[45] Date of Patent: Jun. 20, 2000

[54] METHOD FOR PRODUCING UNIFORM QUALITY COKE

[75] Inventors: Albert Calderon, Bowling Green; Terry James Laubis, Portage, both of Ohio

[73] Assignee: Calderon Energy Company of Bowling Green, Inc., Bowling Green, Ohio

[21] Appl. No.: 09/047,060

[22] Filed: Mar. 24, 1998

[51] Int. Cl.[7] ..... C10B 39/06; C10B 39/04; C10B 39/00; C10B 39/12

[52] U.S. Cl. ..... 201/35; 201/39; 202/227; 202/229; 202/230

[58] Field of Search ..... 201/39, 35; 202/227–230; 422/139, 140, 145–147, 194, 207; 208/48 Q, 50, 53; 239/750–753

[56] References Cited

U.S. PATENT DOCUMENTS 3,950,143 4/1976 Pyle ..... 44/500
4,358,343 11/1982 Goedde et al. ..... 201/1
4,409,067 10/1983 Smith ..... 201/1
5,071,515 12/1991 Newman et al. ..... 201/23
5,607,556 3/1997 Calderon ..... 201/35

*Primary Examiner*—Hien Tran
*Assistant Examiner*—Alexa A. Doroshenk
*Attorney, Agent, or Firm*—Marshall & Melhorn

[57] ABSTRACT

The present invention deals with a method to produce uniform quality coke for a blast furnace by quenching coke at a pre-determined rate to produce coke with essentially uniform moisture; further, this invention possesses specific features to produce coke of uniform stability (strength) by equilibrating the temperature of the coke prior to its being quenched. Uniform moisture and uniform stability are very important factors that contribute to the efficient operation of the blast furnace to result in lowering the cost of making a ton of iron. This method is carried out under pressure, in a closed system, and in an environmentally acceptable manner with minimum formation of $CO_2$. Further, the method possesses additional features which lead to the production of coke of higher stability than obtained conventionally.

8 Claims, 3 Drawing Sheets

METHOD FOR PRODUCING UNIFORM QUALITY COKE

BACKGROUND OF THE INVENTION

This invention deals with the making of a "superior coke" in a closed, pressurized system for use in an iron making furnace such as a blast furnace, wherein iron ore, coke and stone are charged substantially in layers. The coke serves as a fuel and as a base to form a reducing gas in order to convert the iron ore to molten iron. The superior quality of the coke resides in providing coke that is uniform in moisture and uniform in stability. These two features being of major importance for rendering the blast furnace more efficient from the standpoint of productivity, lower coke consumption, and reduction in $CO_2$ formation.

Conventionally, incandescent coke is pushed into a quench car which is moved to a quenching tower, and about 60,000 liters of water are showered onto 26 tons of coke in about 90 seconds in order to cool the coke; this manner of coke quenching results in non-uniform moisture content in the coke. Further in making coke in a space that contains the coal to be coked with indirect heat originating from walls, the coal next to the walls sees a higher temperature than the coal at the center of the space; this condition leads to a coke with a non-uniform stability, the stability of the coke being the strength of the coke which in today's industry standard is set at an index of 60.

Discussion

In having coke that is non-uniform in both moisture and stability, forces the operator of the blast furnace to charge extra coke in order to prevent the furnace from being sluggish. But since the cost of coke in 1997 dollars averaged $130/ton, a reduction in coke consumption of even 3% in a blast furnace of 2.5 million tons of iron capacity/year (with a coke consumption of 0.4 tons of coke/ton of iron), means a net saving in operating costs of $3.9 million in a single year.

In practice, coke of uniform moisture and of uniform high stability means "better coke", by virtue of having a fuel for the blast furnace whose thermal value is predictable, and whose strength resists early deterioration as it descends in the furnace towards the hearth. Therefore to lower operating costs and to minimize the formation of $CO_2$, the reduction in the consumption of coke per ton of molten iron produced becomes paramount.

When making coke from coal by conduction from heat that originates from a hot wall, the coal first expands, and when fully devolatilized the coke contracts. The full contraction of the coke is a necessary requirement to obtain the highest and most uniform stability in the coke, in order to reach this goal of uniform and high stability, the coal must be heated to such a degree as to completely devolatilize the coal with thermal energy to cause all the partitions forming the pores in the coke to shrink to such an extent as to reach a stable limit. Therefore in making coke in an oven which consists of heating coal in a space of about 18 inches which is provided between two walls which are heated indirectly, the coal which is adjacent to the walls is heated to a higher temperature than the coal which is not contiguous to the hot walls. This condition makes the coke non-uniform in stability with the coke produced at the center of the space between the walls being the least stable. In view of the above factors the objectives of the invention are described below.

Objectives Of The Invention

The main object of the present invention is to provide an environmentally closed method that operates at pressure capable of producing coke of uniform moisture.

Another object of the present invention is to provide an environmentally closed method that operates at pressure capable of producing coke of uniform stability.

Still another object of the invention is to provide an environmentally closed method that operates at pressure capable of producing coke of uniform moisture as well as of uniform stability.

Yet another object of the present invention is to provide an environmentally closed method that operates at pressure capable of producing coke of a stability exceeding the standard of 60.

Therefore another object of the present invention is to produce a coke of superior quality in order to lower the operating costs of an iron making furnace by reducing the rate at which the coke is consumed while at the same time reducing the formation of $CO_2$ when making iron.

These and other objects of the instant invention will become apparent from the following drawings and description.

In the detailed description of the invention by means of the drawings, reference will be made with numerals to represent the various components of the apparatus to carry out the method.

DETAILED DESCRIPTION OF THE INVENTION

Figure 1:
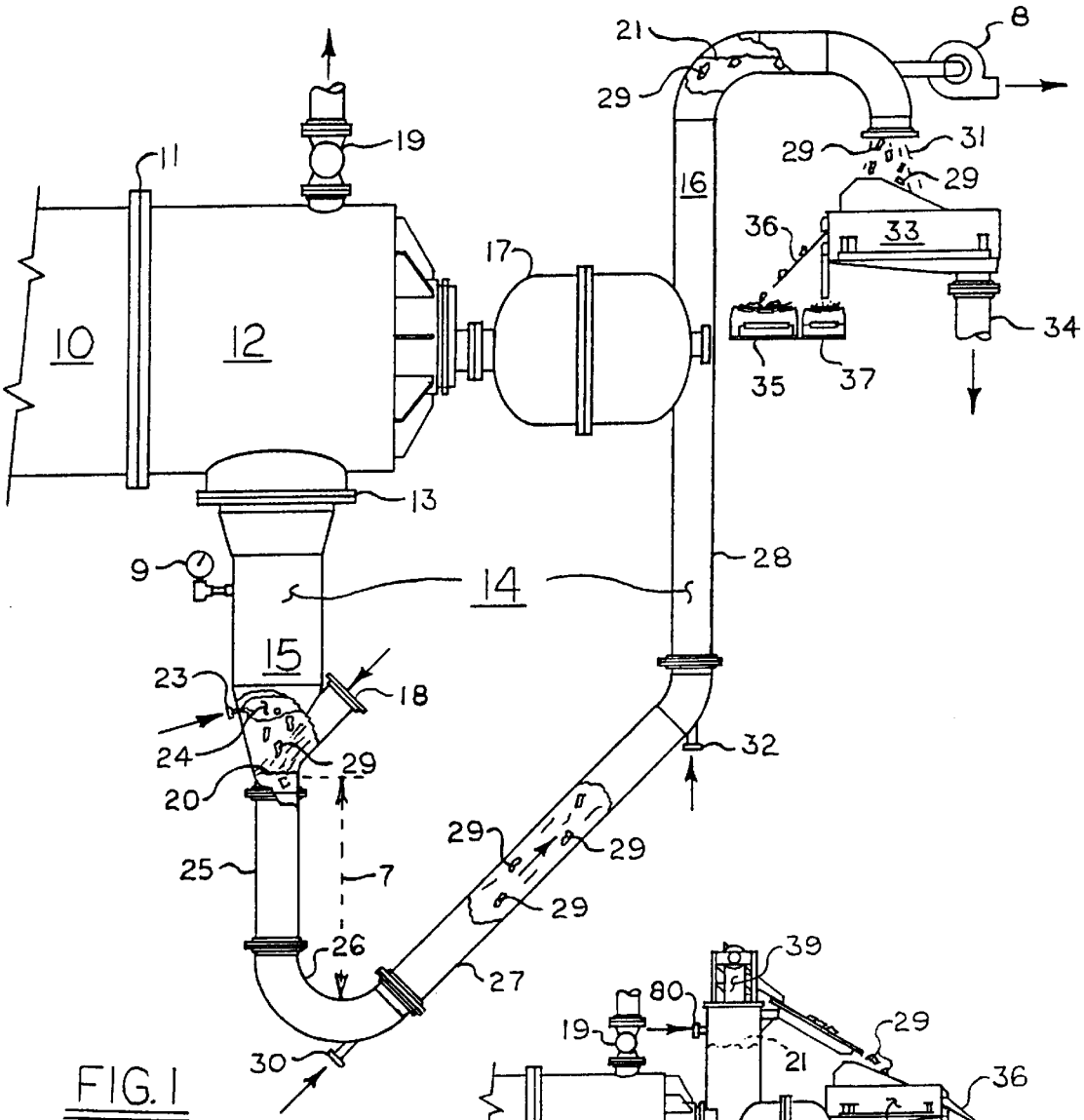
FIG. 1 is an elevation of the apparatus to carry out the method for producing coke of uniform moisture.

Reference is made to FIG. 1, in which numeral 10 is the carbonization (coking) chamber (partially shown) and 11 is the flange to connect elbow 12 to chamber 10. Below elbow 12, flange 13 is disposed, and below flange 13, a barometric leg is situated whose configuration takes the shape of a "simulated" J-pipe which is denoted by numeral 14. J-pipe 14 possesses a process side denoted by numeral 15 and an atmospheric side denoted by numeral 16. Burners such as burner 17, serve to provide the hot flue gases used for carbonization.

On process side 15, inlet 18 is provided and serves to supply a quenching liquid; on atmospheric side 16, liquid outlet 31 is provided. For description purposes the liquid used will be hereinafter referred to as being water, but other liquids may be used as a means for a hydraulic seal. The level of the water is maintained on the process side at level 20 and on the atmospheric side at level 21. The difference in height between levels 20 and 21 is for the purpose of counter-balancing the process pressure as applied to level 20 which is exerted by the gas pressure developed on process side 15. To prevent soluble, gaseous species of hydrocarbons from mixing with the water at level 20, a blanket of steam denoted by numeral 24, is provided to isolate such species from the water. Such blanket of steam is created by providing steam injection nozzle 23 above water level 20. A valve denoted by numeral 19 is provided to control the back pressure within process side 15 of J-pipe 14, with sensor 9 in communication with valve 19, being provided to continuously monitor the pressure within process side 15.

J-pipe 14 is made of section 25, bend 26, riser 27 and standpipe 28. Auxiliary water jets 30 and 32 are also provided to aid in the propulsion of the coke which is denoted by numeral 29, within J-pipe 14. Most coke floats in water; therefore once the coke passes through elbow 26, the buoyancy of the coke helps it rise within pipe 28. A suction means denoted by numeral 8 is provided near the outlet of atmospheric side 16, to collect gas in case it is entrained in J-pipe 14. A safety margin (shown by dotted line) denoted by numeral 7 is provided below level 20 to include extra height to the barometric leg in order to compensate for pressure increase caused by fluctuations to the pressure within process side 15. A coke screen denoted by numeral 33, is located at water outlet 31 where coke and water are separated. A water discharge pipe 34 and a classifier 36 are provided in order to direct the water and coke 29 into separate directions. Screen 33 is also adapted to segregate the fines (also known as "breeze") from the lumps of coke. Conveyors 35 and 37 are disposed below screen 33 with conveyor 35 transporting the lumps of coke and conveyor 37 transporting the breeze.

Figure 2:
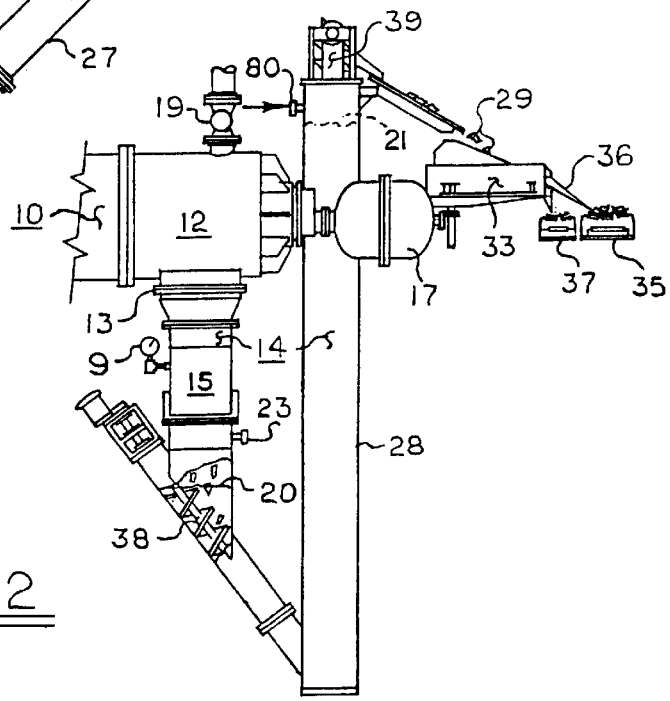
FIG. 2 is an alternate configuration of the apparatus to carry out the method for producing coke of uniform moisture.

FIG. 2 is an alternative configuration of the invention wherein instead of a flood of water being used to hydraulically transport the coke within J-pipe 14, a screw conveyor denoted by numeral 38 is provided for submerging the coke into the water, and a bucket elevator denoted by numeral 39 is provided for raising the coke in standpipe 28 which in turn also serves as the housing for bucket elevator 39. Water make-up nozzle 80 is included to compensate for water loss from barometric leg 14.

Figures 3, 4, 5, 6:
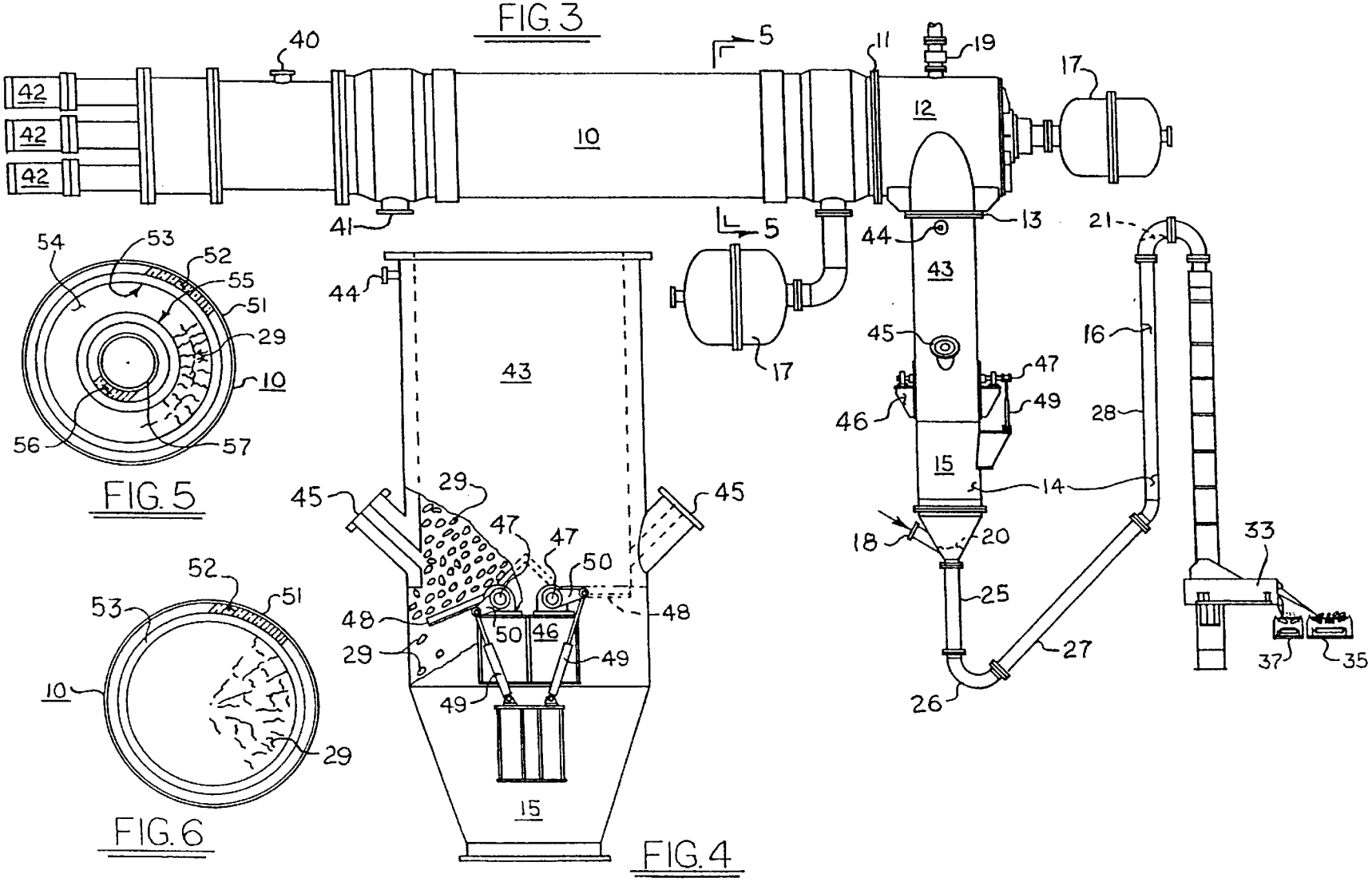
FIG. 3 is another elevation of the apparatus to carry out the method showing the coking chamber for producing coke and a raw gas, the temperature equilibrating zone for producing uniform and high stability coke, and a barometric leg for producing uniform moisture coke.
FIG. 4 is an enlarged and more detailed representation of the temperature equilibrating zone shown in FIG. 3.
FIG. 5 is a section taken at 5—5 of FIG. 3 through the coking chamber.
FIG. 6 is an alternate representation of FIG. 5.

Referring to FIG. 3 numeral 40 is the port through which the coal is introduced and numeral 41 is the port through which the flue gas exits. Numeral 42 represents the cylinder (s) that push the coal into carbonization chamber 10. A temperature equilibrating zone hereinafter referred to as "heat-soaker" is shown by numeral 43; it is interposed between elbow 12 and barometric leg 14; heat-soaker 43 is equipped with inlet port 44 for the introduction of an oxidant such as air or oxygen and gas outlet ports, such as port 45. A coke feed-control device 46 is provided within heat-soaker 43 to meter out the coke in order to prevent the choking (plugging) of coke in barometric leg 14.

Referring to FIG. 4 for a more detailed description of heat-soaker 43, the metering of coke is effected as follows:- feed-control device 46 is made up of rotary shaft 47 to which control gate 48 is connected, and cylinder 49 in turn is connected to shaft 47 via crank 50. The actuation of cylinder 49 opens or closes control gate 48 to control the feed of the coke without choking the flow; coke which is in lump form tends to choke as it flows from hoppers or bins.

Referring to FIG. 5, numeral 54 represents a section of carbonization chamber 10 which takes the form of an annulus configured by outer wall 53 and inner wall 55. Outer wall 53 is backed by insulation 52 which in turn is contained in outer shell 51. Inner wall 55 is backed by insulation 56 which in turn is fastened to inner shell 57. The coke denoted by numeral 29 is contained in annulus 54. FIG. 6 is a variation of FIG. 5 by virtue of its being a cylindrical configuration devoid of annulus 54.

Figure 7:
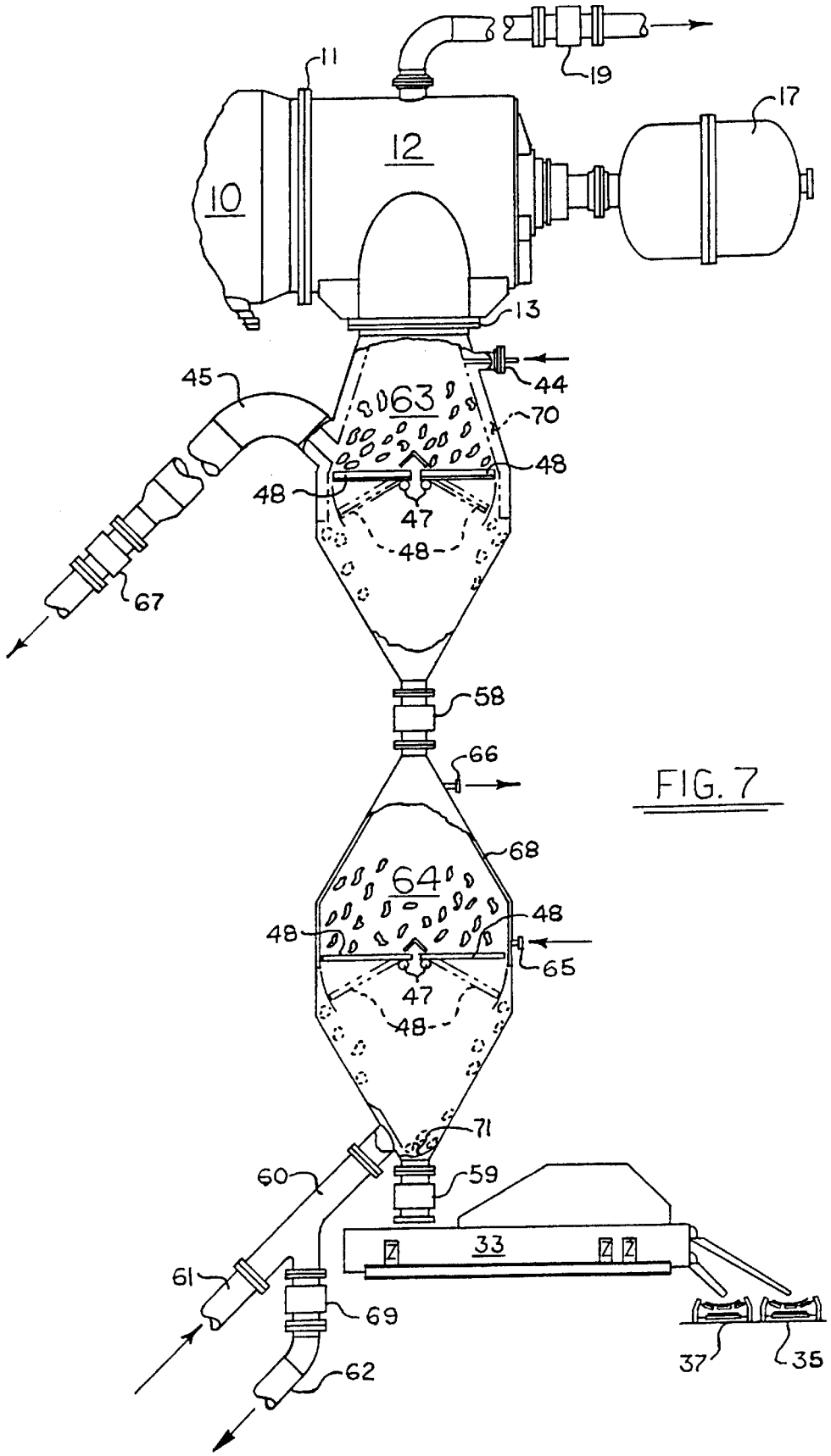
FIG. 7 is an alternate configuration of FIG. 3 wherein high pressure applications are utilized.

When using the invention at high pressure such as five atmospheres and above, the apparatus to carry out the invention takes the configuration shown by FIG. 7. Barometric leg 14 is replaced by heat-soaker 63 which is designed as a pressure vessel followed by lockhopper 64 which is equipped with an upper valve 58 and a lower valve 59, both of these valves being small in diameter relative to heat-soaker 63 or lockhopper 64; lockhopper 64 is also fitted with control gates 48. Control gates 48 in heat-soaker 63 and in lockhopper 64 make possible the use of small diameter valves which are available, economical and easy to maintain; also control gates 48 prevent the choking of the flow of coke from heat-soaker 63 and from lockhopper 64 Heat-soaker 63 is configured to serve as a holder for incandescent coke in order to equilibrate its temperature and also to raise the temperature of the coke by passing hot raw gas through it; valve 67 is disposed downstream of exit port 45 in order to control the flow of the gas from heat-soaker 63. Insulation 70 is provided on the walls of heat-soaker 63 in order to maintain the integrity of the pressure vessel by keeping it cool. Lockhopper 64 which serves as a flood-quenching vessel is designed as a pressure vessel with water inlet 61 and water discharge 62. Valve 69 is provided for quick discharge of the quenching water and is located upstream of discharge 62. To maintain the walls of lockhopper 64 relatively cool, steam jacket 68 is provided with port 65 serving as the steam inlet and port 66 serving as the steam outlet.

Operation of the Invention

Assuming that the method is already in a steady state coking coal in chamber 10, coal is fed at the cold end of chamber 10 and coke is pushed out into elbow 12, with burners 17 producing hot flue gases which supply the thermal energy for converting coal to coke by indirectly heating the coal.

Initially the description of the operation will refer to the method of quenching the coke uniformly using the apparatus shown in FIG. 1 in which steam blanket 24 is continuously maintained. Assuming that a slug of incandescent coke (weighing more than one thousand kilograms) is about to be pushed from coking chamber 10, the water pump (not shown) begins pumping water into process side 15 via inlet 18. As the incandescent coke falling from elbow 12 passes through steam blanket 24 and impacts water level 20, the coke is pulled into the water and gets submerged in the downward flow of the water; the stream of the flowing water acts as a carrier for the coke and transports the coke from process side 15, through pipe 25, bend 26, and riser 27 and into standpipe 28; water jets 30 and 32 assist in such transport. Since most coke is lighter than water, its vertical ascent in standpipe 28 is accelerated. During the transport of the coke in barometric leg 14, the coke is quenched on-the-fly and in a submerged mode, the residence time in the water being set by the volume of water being supplied via inlet 18; the greater the volume of water being pumped into inlet 18 the faster the coke is transported. For a specific moisture, a quantified volume of water is pumped in order to provide a controlled rate of submersion, wherein all the coke sees the same residence time in the quench water.

The coke discharged into the atmosphere through outlet 31, is directed onto screen 33, where the water is separated from the coke, and the coke is roughly classified into coke (above 2 cm) and breeze (below 2 cm). Once the slug of coke is quenched and transported into the atmosphere the pumping of water into inlet 18 is stopped. It is preferred to keep steam blanket 24 active at all times by maintaining the flow of steam through nozzle 23 continuously. An isolation valve within pipe 25 may be incorporated to seal process side 15 when no coke is discharged from chamber 10. Valve 19 which controls the pressure within process side 15, is continuously monitored by means of pressure sensor 9; this valve controls the discharge of the raw gas produced during carbonization. Any increase in pressure caused by pressure fluctuations within process side 15 is absorbed by safety margin 7, thus preventing any gas leaks into the atmosphere. The injected steam rises to elbow 12 and mixes with the raw gas; such mixture is treated in any one of commercially available gas cleanup systems (not shown); the entrained gas in J-pipe 14 is collected by suction means 8, and may also be treated by the same gas cleanup system.

The operation described by FIG. 1 may be modified by employing mechanical means such as conveyor 38, to immerse the coke into water level 20 and by using a mechanical means such as a bucket elevator 39, to raise the coke above water level 21, this modification being shown in FIG. 2.

Referring to FIGS. 3 and 4, when the incandescent coke is pushed out of elbow 12, it is stored in heat-soaker 43 where a surge capacity of several tons is maintained; the coke is equilibrated in temperature within heat-soaker 43, by virtue of hot coke made adjacent to the walls of chamber 10, comes in contact with cooler coke that was made away from the walls of chamber 10. In addition to this equilibration, at least a portion of the transferred heat by conduction and radiation from the raw gas produced from devolatilization of the coal, effected by directing downwardly through the coke mass stored in heat-soaker 43, a portion of this gas after having been reacted with air or oxygen introduced via port 44, to increase the temperature of the gas prior to directly contacting the coke mass; this further equilibrates the temperature of the coke and also elevates the temperature of the coke to a higher degree by efficiently heat-soaking the entire mass contained in heat-soaker 43 by direct contact with hot gas. The gas after filtering through the mass of the coke is exhausted via port 45. It has been found through actual tests that the stability of coke made from the same blend of coal can be increased from 59.6 to 64.3 with a heat-soak; this is a significant improvement in the strength of the coke.

Periodically control gates 48 are activated by means of cylinder(s) 49 to feed in a controlled manner, the temperature equilibrated coke into barometric leg 14 without chocking;

the coke is first submerged into the water at level 20 and is quenched at a pre-determined rate.

The quenched coke is discharged into the atmosphere without emissions, and is subsequently screened as explained above using FIG. 1 for reference.

Barometric leg 14 can conceivably be used as a quenching system for several atmospheres possibly such as up to 5 since for one atmosphere a height of about 10 meters needs to be provided. However, in applications wherein a system needs to be operated at pressures exceeding 5 atmospheres, it is preferred to use the configuration shown in FIG. 7 wherein special pressure vessels are used such as vessels 63 and 64 wherein vessel 63 is the heat-soaker and vessel 64 is a lockhopper. In the case of heat-soaker 63, the gas flow for heating the coke is controlled by proportioning valves 19 and 67, and by using lockhopper 64, the coke contained above gates 48 is periodically flooded with water and then rapidly drained at a pre-determined rate in order to control the residence time of the coke being submerged in water. Valve 69 controls the rate of flow during the draining of the water from lockhopper 64. To prevent the loss of pressure of the system while eliminating emissions into the atmosphere, valves 58 and 59 are operated as follows:- valve 58 is kept open and valve 59 is kept closed during the transfer of coke from heat-soaker 63, during the flood-quenching of the coke in lockhopper 64, and during the draining of the water from lockhopper 64. Conversely, valve 58 is kept closed and valve 59 is kept open during the discharge of the coke onto screen 33; during such discharge of coke feed control gates 48 in lockhopper 64 are activated to prevent the choking of lockhopper 64 at its convergent outlet which is denoted by numeral 71.

The details of the method described above, by making reference to various pieces of apparatus, are for the purpose of description and not limitation by virtue that other configurations are possible without departing from the spirit of the invention. Therefore I claim the following:

What is claimed is:

1. A method for producing coke of uniform moisture operating at a pressure greater than atmospheric pressure, comprising:

a) carbonizing coal in a coking chamber to form incandescent coke;

b) discharging the incandescent coke formed in said coking chamber into a quenching chamber in order to cool the coke, said quenching chamber taking the shape of a barometric leg having a process side and an atmospheric side wherein the atmospheric side contains a column of liquid of sufficient height to counterbalance the pressure maintained within the process side to provide in combination a hydraulic seal and a coke quenching means; and c) transporting the coke from the process side to the atmospheric side without loss of pressure from the process side of said barometric leg, at such a rate as to control the residence time at which the coke is submerged in said column of liquid in order to control the moisture content of the coke and thus produce coke of uniform moisture.

2. A method for producing coke of uniform stability, comprising:

a) carbonizing coal in a coking chamber to form incandescent coke and generate a raw gas;

b) discharging the incandescent coke formed in said coking chamber into a heat-soaking chamber in order to equilibrate the temperature of the coke discharged from said coking chamber;

c) combusting at least a portion of the raw gas generated in said coking chamber upstream of said heat-soaking chamber to raise the temperature of the raw gas above that of the incandescent coke, and then directly contacting the coke in the heat-soaking chamber with the raw gas to thereby raise the temperature of the coke; and d) quenching the coke uniformly in a chamber by controlling the time for which the coke is submerged in a liquid, such quenching being subsequent to the coke being equilibrated in temperature in order to produce coke of uniform stability and uniform moisture.

3. The method as set forth in claim 2 further comprising discharging the coke into the atmosphere without causing significant emissions to the atmosphere or loss of pressure to the system.

4. A method as defined in claim 2, wherein the coke is maintained in contact in the heat-soaking chamber with the raw gas for a sufficient length of time to insure that the coke is uniformly equilibrated at the raised temperature in order to produce uniform and high stability coke.

5. The method as set forth in claim 4 further comprising discharging the coke into the atmosphere without causing significant pollution to the atmosphere or loss of pressure to the system.

6. A method as defined in claim 2, wherein the chamber in which said coke is quenched includes a barometric leg.

7. A method as defined in claim 6, wherein said barometric leg has a process side and an atmospheric side, the atmospheric side containing a column of liquid of sufficient height to counter-balance the pressure maintained within the process side to provide in combination a hydraulic seal and a coke quenching means.

8. A method as defined in claim 7, wherein the coke is transported from the process side to the atmospheric side of the chamber, without loss of pressure from the process side of said barometric leg, at such a rate as to control the residence time at which the coke is submerged in said column of liquid in order to control the moisture content of the coke and produce coke of uniform moisture.

* * * * *